US006362801B1

(12) United States Patent
Yuhara

(10) Patent No.: US 6,362,801 B1
(45) Date of Patent: Mar. 26, 2002

(54) DISPLAY APPARATUS

(75) Inventor: Yuuji Yuhara, Kawasaki (JP)

(73) Assignee: Engineer Lighting, Inc., Tokyo (JP)

( * ) Notice: Subject to any disclaimer, the term of this patent is extended or adjusted under 35 U.S.C. 154(b) by 0 days.

(21) Appl. No.: 09/504,390

(22) Filed: Feb. 15, 2000

Related U.S. Application Data

(63) Continuation of application No. PCT/JP99/03217, filed on Jun. 16, 1999.

(30) Foreign Application Priority Data

Jun. 17, 1998 (JP) ..... 10-170055

(51) Int. Cl.[7] ..... G09G 3/32
(52) U.S. Cl. ..... 345/82; 345/83
(58) Field of Search ..... 345/82, 83, 84, 345/76

(56) References Cited

U.S. PATENT DOCUMENTS 5,150,445 A * 9/1992 Toyoda et al. ..... 385/116
5,428,365 A * 6/1995 Bailey et al. ..... 345/55
5,532,711 A * 7/1996 Harris ..... 345/55
5,900,850 A * 5/1999 Bailey et al. ..... 345/55
5,940,683 A * 8/1999 Holm et al. ..... 438/23

FOREIGN PATENT DOCUMENTS

| | | | |
|---|---|---|---|
| JP | 1123285 | 7/1989 | ..... G09F/9/33 |
| JP | 2278282 | 11/1990 | ..... G09F/9/33 |
| JP | 4122980 | 4/1992 | ..... G09F/9/33 |
| JP | 533183 | 4/1993 | ..... G09F/9/33 |
| JP | 7335942 | 12/1995 | ..... H01L/33/00 |

* cited by examiner

*Primary Examiner*—Richard Hjerpe
*Assistant Examiner*—Abbas Abdulselam
(74) *Attorney, Agent, or Firm*—Volpe and Koenig, P.C.

(57) ABSTRACT

A display apparatus of the present invention is featured in that luminance-controllable display modules are attached as pixels to a flexible net having a mesh portion. To be more specific, the display apparatus of the present invention is characteristically provided with a flexible net made in such manner that a flexible net member (which is preferably transparent) constitutes a display screen area, luminance-controllable display modules attached to the flexible net and arranged in a matrix fashion, and two-dimensional selection/display control means (e.g., a master PC[1], slaves PC[3], X and Y control units [11X~, 11Y~], etc.) for two-dimensionally selecting the display modules and controlling the luminance of the selected ones of the display modules.

3 Claims, 5 Drawing Sheets

DISPLAY APPARATUS

CROSS-REFERENCE TO RELATED APPLICATION

This is a continuation of application Ser. No. PCT/JP 99/03217, filed Jun. 16, 1999.

This application is based upon and claims the benefit of priority from the prior Japanese Patent Application No. 10-170055, filed Jun. 17, 1998; the entire contents of which are incorporated herein by reference.

BACKGROUND OF THE INVENTION

The present invention relates to a display apparatus that employs luminance-controllable display modules as its light emission devices. For example, the present invention relates to a display apparatus applicable to a large-sized stage image display or the like.

The conventionally-known display apparatuses of this type include a so-called luminance display board. This luminance display board has a plurality of light-emitting elements (e.g., LEDs) which are arranged at predetermined positions on a board type support member and the luminance of which is controlled by a controller.

The luminance display board comprises the support member formed of a rigid material. Therefore the luminance display board is inevitably installed in a fixed manner. This being so, the luminance display board has to be designed in accordance with the installation place after due consideration of the installation conditions (e.g., the installation position, or the installation posture). The luminance display board, thus designed, has to be installed by following the installation procedures with high accuracy.

In other words, there is a low degree of freedom when the luminance display board is installed. Since the luminance display board cannot be installed in a flexible manner in accordance with the installation conditions of the installation place, it cannot be easily applied to a stage display apparatus.

The plate-like support member formed of a rigid material is heavy. Therefore the large-sized luminance display board is not suitable for conveyance and cannot be easily moved. Accordingly, the installation is a large-scale operation and takes much time.

As described above, the luminance display board of the conventional display apparatus is fixed in the manner of installation. In other words, the installation manner of the display board cannot be flexibly determined in accordance with the conditions of the installation place. In addition, the display board is heavy, and the installation operation is inevitably large in scale.

An object of the present invention is to provide a display apparatus having the following advantages:

(a) The display screen can be installed in arbitrary manners (the installation position, the installation posture, etc.) in accordance with the conditions of the installation place. For example, the display screen can be installed in such a manner as to provide a three-dimensional curved surface.

(b) The display screen is light in weight, thus enabling an easy installation operation as well as easy conveyance and easy elevation.

(c) The background located on the rear side of the display screen can be observed, and the display screen can be illuminated from behind. When the subject display apparatus is used as a stage apparatus, desirable stage effects can be expected.

BRIEF SUMMARY OF THE INVENTION

To solve the above problems and attain the above purpose, the present invention provides display apparatuses of the following structures:

[1] A display apparatus of the present invention is characterized by comprising: a flexible net having a mesh portion; and luminance-controllable display modules which are attached to the flexible net as pixels.

Owing to the flexibility of the flexible net, the display screen of the display apparatus can be changed in posture in an arbitrary manner.

[2] Another display apparatus of the present invention has the same features as the display apparatus described in [1] above, and is characterized in that each of the display modules is attached to the flexible net by arranging a wiring board, which incorporates a luminance control circuit having light-emitting elements, and a display board, which has a window for allowing the light-emitting elements to exposed, on the obverse and reverse sides of the flexible net, respectively, in such a manner as to face each other, and by coupling the two boards to each other through the mesh portion of the flexible net.

Since the display modules are attached by utilizing the mesh portion of the flexible net, the display apparatus is easy to install and can be manufactured at low cost.

[3] Another display apparatus of the present invention has the same features as the display apparatus described in [1] above, and is characterized in that the flexible net is made in such manner that a flexible net member (which is preferably transparent) constitutes a display screen area.

Since the display screen area of the above display apparatus is a mesh portion, the background located on the rear side of the display screen is seen through the mesh portion that is between the adjacent ones of the display modules attached to the flexible net. In addition, illumination or other special effects can be performed from behind the display screen. Hence, attractive stage effects can be produced by employing the subject display apparatus as a stage apparatus.

[4] Another display apparatus of the present invention is characterized by comprising: a flexible net made in such manner that a flexible net member constitutes a display screen area; luminance-controllable display modules attached to the flexible net and arranged in a matrix fashion; and two-dimensional selection/display control means (a master PC [1], slaves PC [3], X and Y control units [11X~, 11Y~], etc.) for two-dimensionally selecting the display modules and controlling the luminance of the selected ones of the display modules.

Owing to the flexibility of the flexible net, the display screen portion of the display apparatus can be changed in posture in an arbitrary manner, as described in [1] above. In addition, the display apparatus can show an image in a similar manner to that of an ordinary TV screen.

[5] Another display apparatus of the present invention has the same features as the display apparatus described in [4] above, and is characterized in that each of the display modules is made by assembling three-primary color LEDs of red, blue and green on a wiring board, along with sample-and-hold circuits and a LED driver.

The display apparatus described above has similar advantages as the display apparatus described in [4] above. In addition, the three-primary color LEDs and the fewest possible luminance control circuits are provided on the wiring board to which the display modules, serving as pixels capable of displaying a color image, are assembled. All the other necessary electric circuits are provided as an external control circuit. With this structure, each of the display modules is compact in size, resulting in easy manufacture. In addition, each display module is easy to handle.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION (One Embodiment)

[Constitution]

Figure 1:
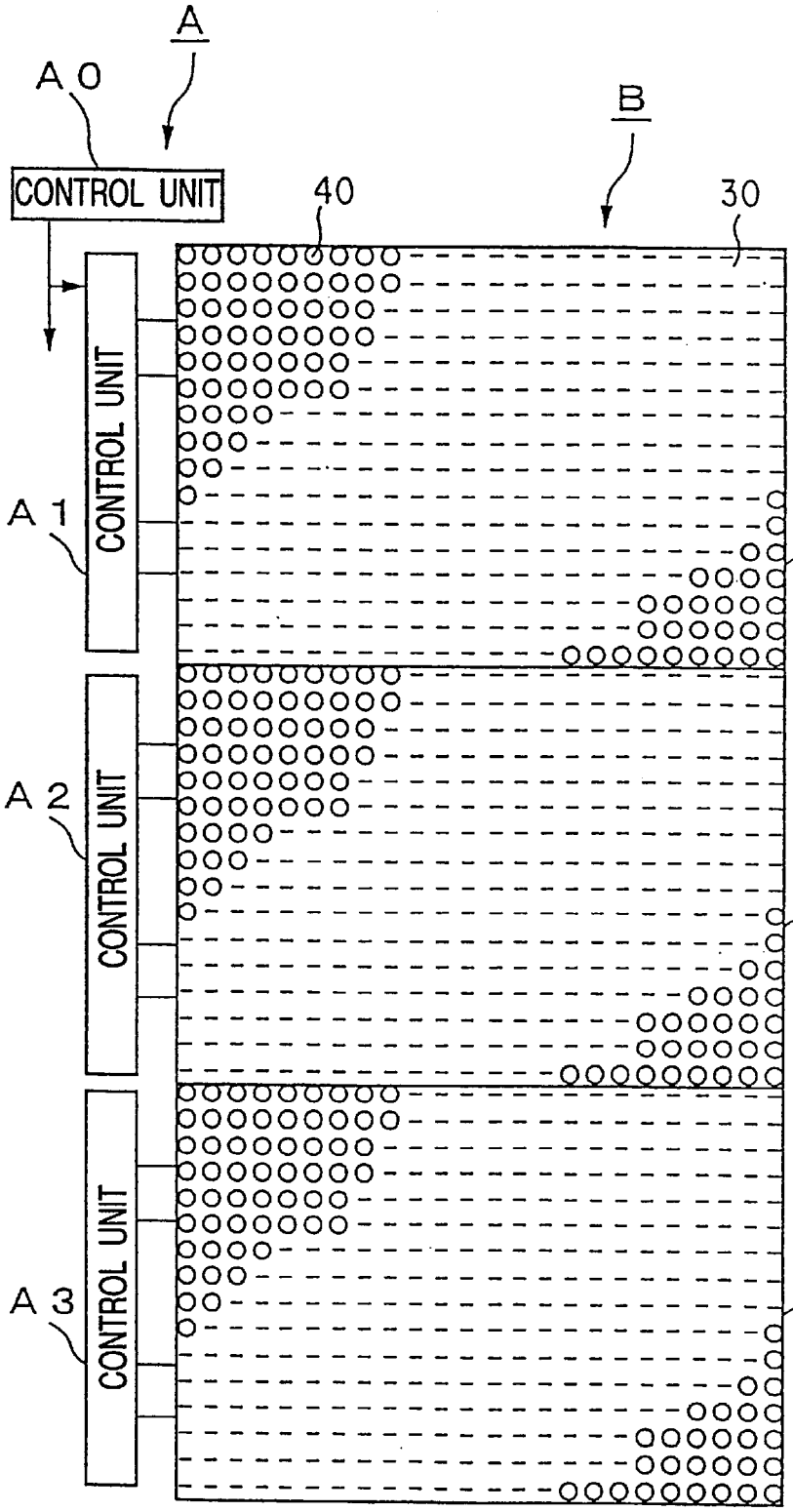
FIG. 1 is a schematic front view showing the entire display apparatus according to one embodiment of the present invention.
Figure 2:
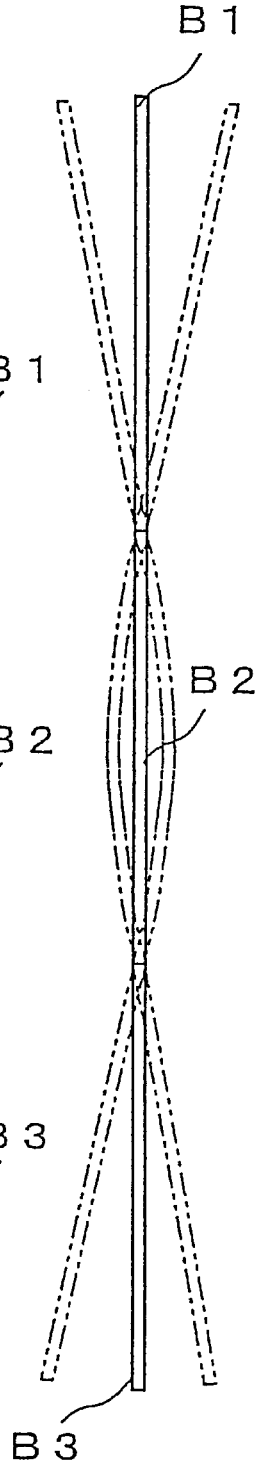
FIG. 2 is a schematic side view showing the entire display apparatus according to one embodiment of the present invention.

FIGS. 1 and 2 are schematic views showing the entire display apparatus according to one embodiment of the present invention. In FIGS. 1 and 2, "A" represents a control system, and "B" represents a display system.

The control system "A" shown in FIG. 1 is made up of: a control unit A0 including a master CPU to be described later, and a first control unit A1, a second control unit A2, a third control unit A3 . . . These control units operate based on control instructions supplied from the control unit A0. Each of control units A1, A2, A3, . . . includes a slave PC and X and Y control unit, which are to be described later, as well as other elements.

The display system "B" is made up of a first display unit B1, a second display unit B2, a third display unit B3, . . . These display units are connected to control units A1, A2, A3, . . . respectively, in one-to-one correspondence.

The number of control units A1, A2, A3, . . . and the number of display units B1, B2, B3, are not particularly restricted; they can be arbitrarily determined. For the sake of a simple description, however, the present embodiment will be described on the assumption that three control units and three display units are provided.

In the present embodiment, three independent units are assembled as one. To be more specific, the three screens of display units B1–B3 constitute one large-sized screen capable of displaying a color image.

As will be described later, the display screen section of the display units B1–B3 is made by providing a large number of luminance-controllable display modules 40 for a flexible net 30, which is made of a flexible net member. The display modules 40 are arranged in a matrix fashion and serve as so-called pixels. Owing to the flexibility of the flexible net 30, the display screen section can be changed in posture to a certain extent.

FIG. 2 is a side view of the display apparatus, and an example of a manner in which the posture is changed is indicated by the broken lines. The display screen section of the display units B1–B3 can be flexed or curved in such a way that it is concave or convex when viewed from the region in front of it (the region being the right portion of the Figure), as indicated by the two-dot-dash lines in the Figure. With this structure, the image on the display screen section gives a panoramic sense or the like to the observer.

Figure 3:
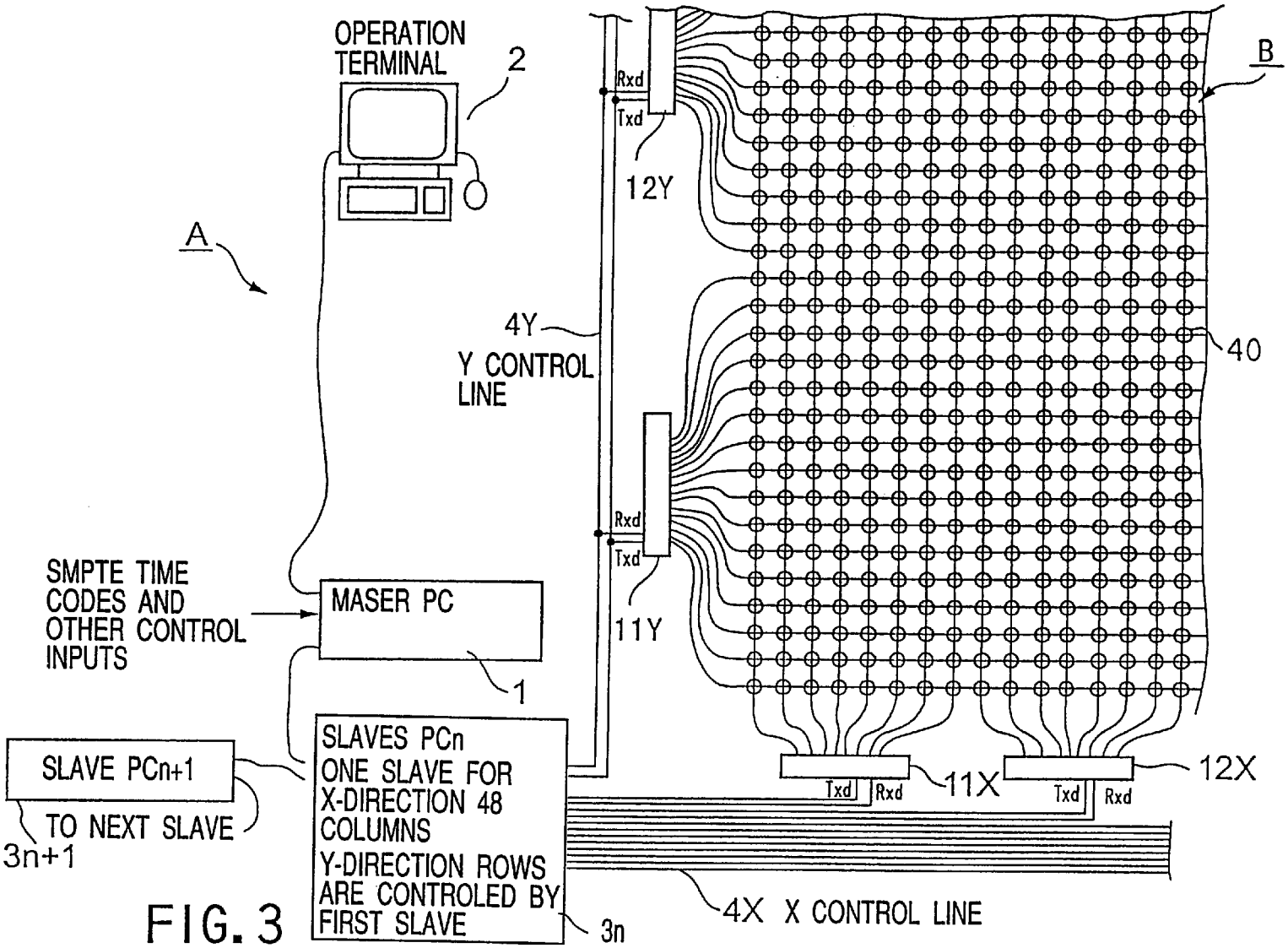
FIG. 3 is a block diagram showing a control system employed in the display apparatus according to one embodiment of the present invention.

FIG. 3 is a block diagram showing a control system employed in the display apparatus of the present embodiment. As shown in FIG. 3, the control system "A" comprises a master (PC) 1, an operation terminal 2, a slave (PC) 3n, a slave (PC) 3n+1, . . . an X control line 4X, a Y control line 4Y, X control units 11X, 12X, . . . , Y control units 11Y, 12Y, . . . etc.

The master (PC) 1 and operation terminal 2 shown in FIG. 3 are used for the entire display system B, and correspond to the control unit A0 shown in FIG. 1.

The slave (PC) 3n, the slave (PC) 3n+1, . . . , X control units 11X, 12X, . . . , Y control units 11Y, 12Y, . . . , etc. are employed by one of the units of the display system "B", for example, by unit B1, and correspond to one of the control units shown in FIG. 1, e.g., control unit A1.

As can be seen from the above, slaves (PC), X and Y control units, etc. having a similar structure as described above are provided for control units A2 and A3 shown in FIG. 1, but illustration of such elements is omitted in FIG. 3.

As shown in FIG. 3, the X control units 11X, 12X, . . . are connected to the display modules 40 arranged in a matrix manner, in such a manner that one control unit corresponds to a bundle of X wiring lines extending in an X direction (i.e., the vertical direction in the Figure). Likewise, the Y control units 11Y, 12Y, . . . are connected to the display modules 40 arranged in a matrix manner, in such a manner that one control unit corresponds to a bundle of Y wiring lines extending in a Y direction (i.e., the horizontal direction in the Figure).

With the above structure, the X control units 11X, 12X . . . and the Y control units 11Y, 12Y . . . constitute the major section of a two-dimensional selection/display control means, which two-dimensionally selects a large number of display modules arranged in a matrix manner and controls the luminance of the selected display modules 40.

Figure 4:
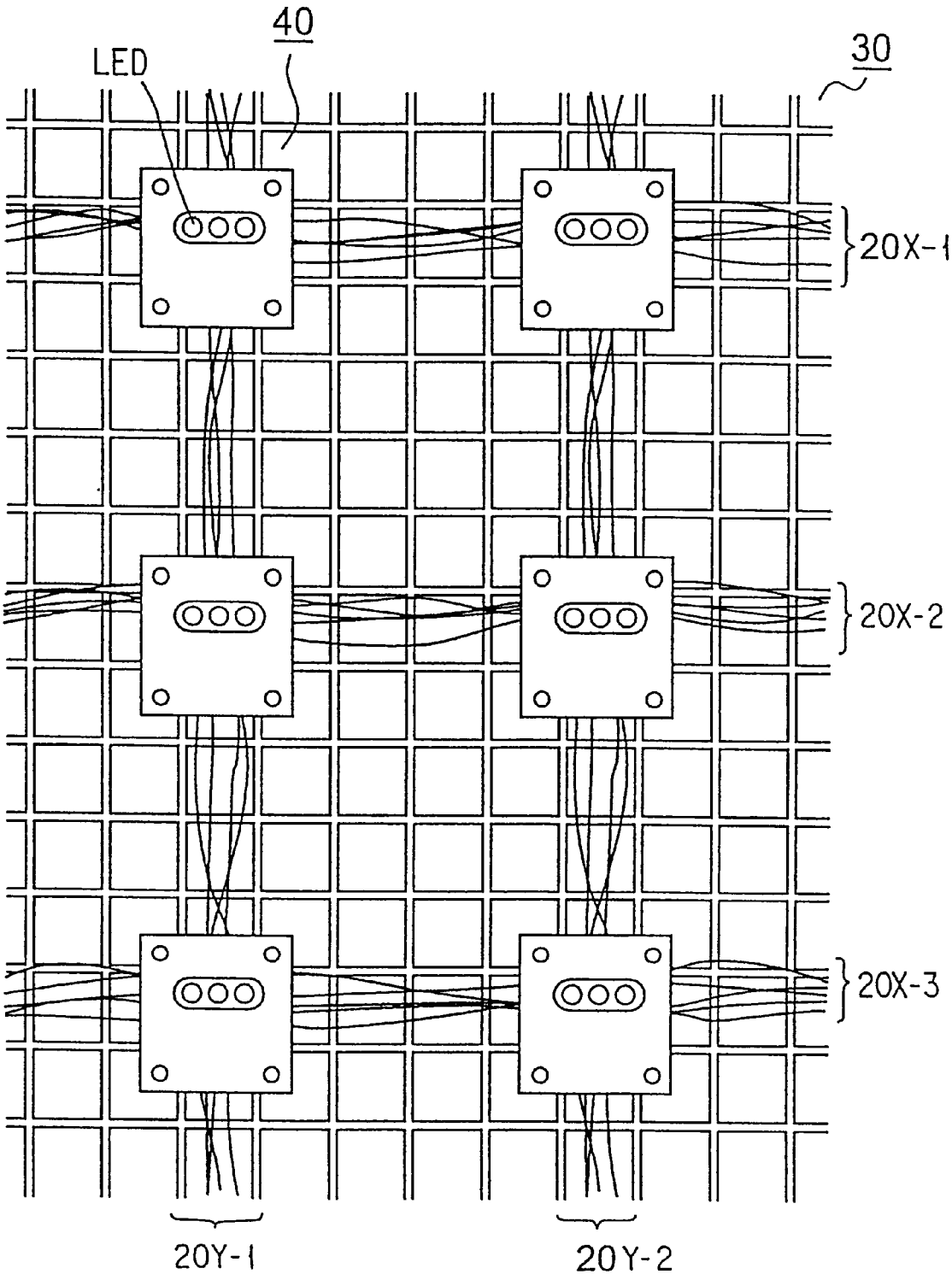
FIG. 4 is an enlarged front view showing part of the display screen of the display apparatus according to one embodiment of the present invention.

FIG. 4 shows how the display screen section made up of the display units B1–B3 looks like, and is an enlarged front view showing part of the display screen section. As shown in FIG. 4, the flexible net 30 is a net member formed of flexible synthetic resin (preferably, transparent resin), and the length and width of that flexible net 30 are determined in such a manner that the size (area) of the net 30 is equal to that of the display screen area. A large number of luminance-controllable display modules 40 are attached to the flexible net 30 in a matrix manner. Each of the display modules 40 comprises a square base plate, and three-primary color LEDs of red, blue and green provided on the base plate, X wiring line bundles 20X-1, 20X-2, . . . each of which is made up of a number of signal lines, are connected to the display modules 40 such that each bundle corresponds to one X-direction array of display modules 40 (the X direction being the horizontal direction as viewed in the Figure).

Likewise, Y wiring line bundles 20Y-1, 20Y-2, . . . , each of which is made up of a number of signal lines, are connected to the display modules 40 such that each bundle corresponds to one Y-direction array of display modules 40 (the Y direction being the vertical direction as viewed in the Figure).

Figure 5:
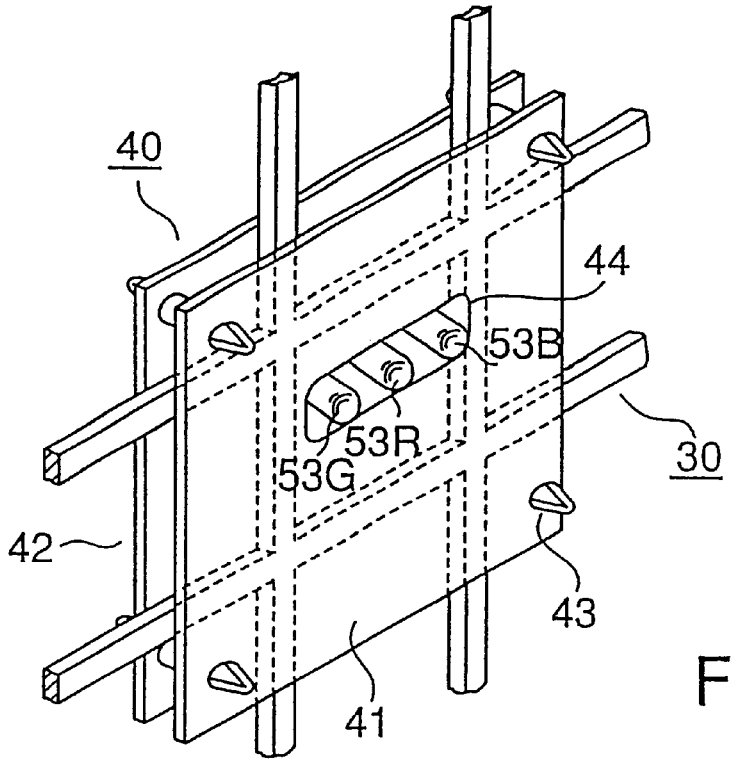
FIG. 5 is a perspective view showing the front side of a display module employed in the display apparatus according to one embodiment of the present invention.
Figure 6:
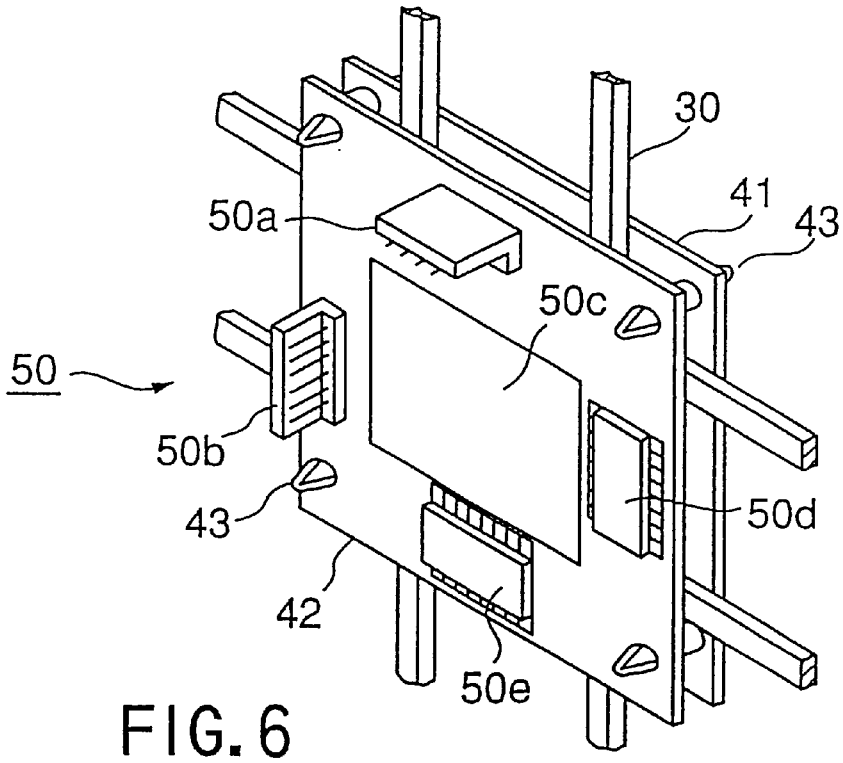
FIG. 6 is a perspective view showing the rear side of a display module employed in the display apparatus according to one embodiment of the present invention.

FIGS. 5 and 6 are perspective views of a display a module. FIG. 5 is a perspective view showing the front side, and FIG. 6 is a perspective view showing the rear side. As shown in FIGS. 5 and 6, the display module 40 comprises: a square display board 41 located on the front side; a square wiring board 42 located on the reverse side; four coupling pins 43 that couples the two boards together at their corners; a window 44 located in the substantial center of the display board 41 and exposing luminance elements (i.e., three-primary color LED53R of red, LED53B of blue and LED53G of green) to the outside; and a luminance control circuit 50 arranged on the wiring board 42 and including the luminance elements.

A Y wiring connection terminal 50*a*, an X wiring connection terminal 50*b*, a print wiring section 50*c* and IC circuits 50*d* and 50*e* are assembled on the reverse side of the wiring board 42. The luminance elements, namely, the three-primary color LEDs (53R, 53G, 53B) of red, blue and green, are located on the front side of the wiring board 42, i.e., on the side opposite to that where the print wiring section 50*c*, etc. are arranged. The luminance elements have their light-emitting portions exposed to the outside through the window 43 of the display board 41.

The display modules 40 is attached to the flexible net 30 in the following steps. First, the display and wiring boards 41 and 42 are arranged on the front and rear sides of the flexible net 30, respectively, in such a manner they face each other. Four coupling pins 43 are inserted through fixing holes (not shown) formed at the respective corners of the boards, with the coupling pins passing through mesh portions of the flexible net 30. As a result, the boards are coupled together, and the resultant display modules 40 is fixed to the flexible net 30.

Figure 7:
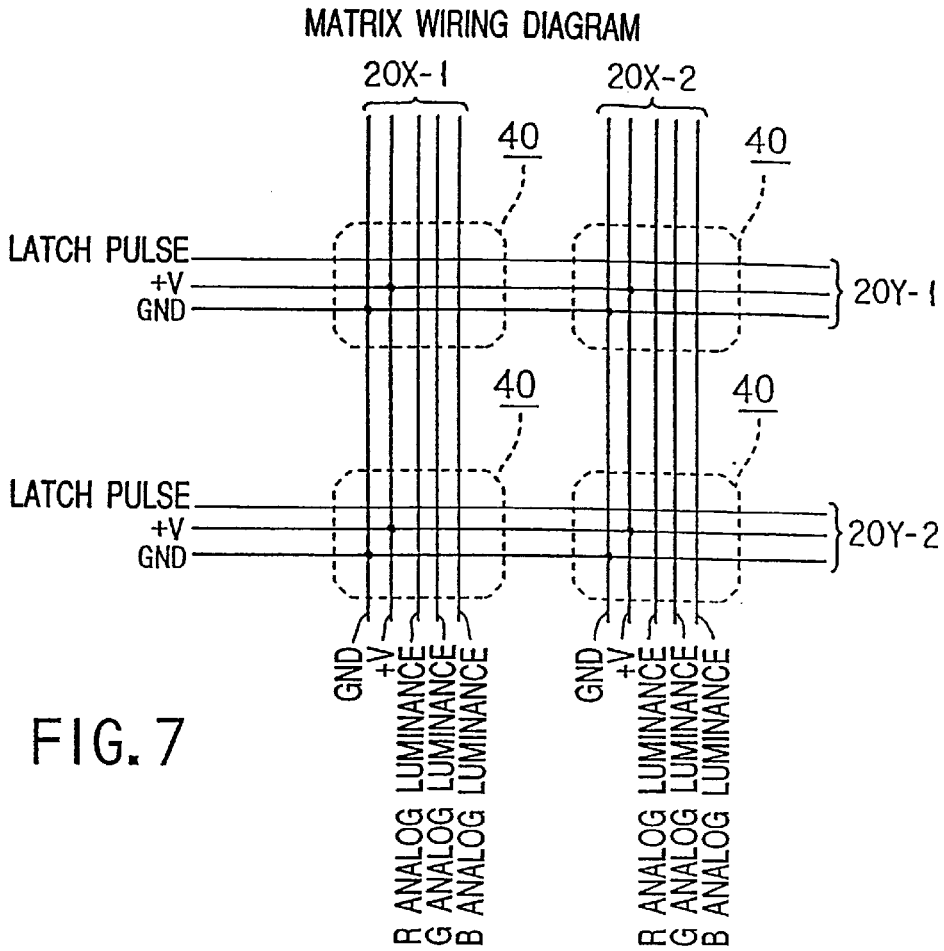
FIG. 7 is a matrix wiring diagram showing the electric constitution of display modules employed in the display apparatus according to one embodiment of the present invention.

FIG. 7 is a matrix wiring diagram showing the electric constitution of the display modules 40. As shown in FIG. 7, the display modules 40 of each of the columns extending in the x direction (the x direction being the vertical direction as viewed in the Figure) are connected to one of the X wiring line bundles 20X-1, 20X-2, . . . Each of these X wiring line bundles includes a B analog luminance signal line, a G analog signal luminance line, an R analog signal luminance line, a +V line, and a GND line.

Likewise, the display modules 40 of each of the rows extending in the Y direction (the Y direction being the horizontal direction as viewed in the Figure) are connected to one of the Y wiring line bundles 20Y-1, 20Y-2, . . . Each of these Y wiring line bundles includes a latch pulse line, a +V line, and a GND line.

Figure 8:
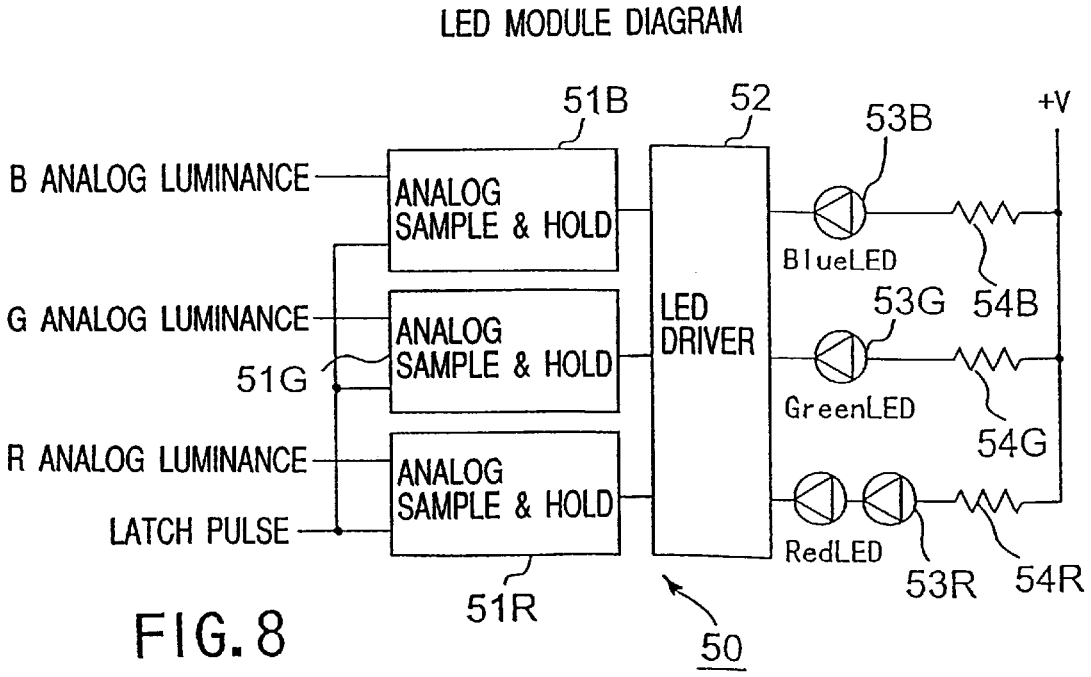
FIG. 8 is a diagram showing the electric constitution of a display module employed in the display apparatus according to one embodiment of the present invention, the Figure showing the specific configuration of a luminance control circuit employed in the module.

FIG. 8 is a diagram showing the electric constitution of a display module 40. Specifically, it illustrates a luminance control circuit 50 incorporated in the display module 40. As shown in FIG. 8, the luminance control circuit 50 comprises: analog sample-and-hold circuits 51R, 51G and 51B corresponding to the three-primary colors of red, blue and green; an LED driver 52; LEDs 53R, 53G and 53B corresponding to the three-primary colors of red, blue and green; and current-limiting resistors 54R, 54G and 54B.

[Operation]

The display operation performed by the present display apparatus of the above constitution may be summarized as follows;

1) Image data are sequentially written in the frame buffer memory of the slave PC provided for each display pixel. If the image data are still-image data, they are written in accordance with the required display time. If the image data are motion-picture data, they are written in accordance with the required frame rate.
2) After the completion of the frame buffer rate change, the pixel data on the first line are serially transferred to the X control units 11X, 12X . . . corresponding to column addresses.
3) Each of the X control units 11X, 12X . . . converts the data it receives into analog signal, which are to be supplied to the LEDs 53R, 53G and 53B of the display modules (i.e., the pixels) corresponding to the column addresses. Then, each X control unit outputs the analog signal to the corresponding one of the X wiring line bundles 20X-1, 20x-2, . . . , which serve as RGB data-buses.
4) After the analog signals corresponding to all column addresses are output, the Y (row) control units 11Y, 12Y . . . output latch pulses, i.e., start pulses for starting the sample-and-hold operation of the first row.
5) In response to the latch pulses for the sample-and-hold operation, the display modules 40 (i.e., pixels) hold RGB column data, cause the LEDs to emit light by application of a predetermined level of voltage thereto, and maintains this state until the next sampling cycle.
6) To output data on the second and subsequent rows, the row counters of the slave PCs are incremented, and the operation starting from step 2) is repeated.
7) The operation described above is repeated until the last row of the frame buffer memory.

In the case of image display for a video or a TV, the frame rate required is 30 frames per second. Therefore, step 1) described above is executed in accordance therewith. In the case of animation display, step 1) is executed in accordance with the required animation rate. In the case of still image display, step 1) is not necessary unless a request is made for changing the image presently shown on the screen.

[Advantage]

According to the display apparatus of the present embodiment, the display modules 40 serving as pixels are attached to the flexible net 30. Therefore, when the display screen section is installed, its posture (a direction, or an angle) can be arbitrarily determined. In addition, it can be curved three dimensionally. In comparison with the conventional art where a rigid plate is employed as a support base member, the display screen section of the present embodiment is remarkably light in weight since the flexible net itself is very light. This being so, the entire display apparatus is remarkably easy to convey or elevate. Further, since the display modules 40 serving as pixels are attached to the flexible net 30, with predetermined intervals maintained, the background located on the rear side of the display screen is seen through the mesh portion between the adjacent display modules 40. In addition, illumination or other special effects can be performed from behind the display screen. Hence, attractive stage effects can be produced by employing the subject display apparatus as a stage apparatus.

(Modification)

The display apparatus according to the embodiment described above is intended to cover the following modifications:

- a modification wherein the flexible net is made of bamboo, wood, or metal;
- a modification wherein elements other than LEDs are employed as the light-emitting elements; and
- a modification wherein the control system shown in FIG. 2 is replaced with an ordinary control means.

The display apparatus according to the present invention employs a flexible net as its support member. Therefore, the display screen section can be installed in arbitrary installation manners (the installation position, the installation posture, etc.) in accordance with the conditions of the installation place. For example, the display screen section can be installed in such a manner as to provide a three-dimensional curved surface. In addition, the use of the flexible net as a support member offers another advantage that the display screen is remarkably light in weight, thus enabling an easy installation operation as well as easy conveyance and easy elevation. Moreover, since the display modules serving as pixels are attached to the flexible net, with predetermined intervals maintained, the background located on the rear side of the display screen is seen through the mesh portion between the adjacent display modules. Owing to this structure, illumination or other special effects can be performed from behind the display screen. Hence, attractive stage effects can be produced by employing the subject display apparatus as a stage apparatus. As can be seen from this, the display apparatus of the present invention has a wide range of application; for example, it is applicable to a large-sized stage image display apparatus, a full-color electric spectaculars system, or the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display apparatus comprising:

a flexible net formed of a flexible member so as to constitute a net-like display screen area having a plurality of mesh portions;

a plurality of luminance-controllable display modules attached to the flexible net as pixels; and two-dimensional selection/display control means for two-dimensionally selecting the display modules and controlling luminance of selected ones of the display modules, each of said plurality of display modules further compromising:

a wiring board having a plurality of corner portions into which luminance control circuits each including light-emitting elements are respectively incorporated;

a display board having a shape and a size identical to a shape and size of the wiring board and having a window for allowing the light-emitting elements to be exposed; and attachment means for integrally attaching the wiring board and the display board to the flexible net, by respectively arranging the wiring board and the display board on obverse and reverse sides of the flexible net in such a manner that the wiring board and the display board face each other, while simultaneously respectively coupling the plurality of the corners of the wiring board with the plurality of the corners of the display board with a plurality of coupling pins such that each of the plurality of coupling pins penetrates different mesh portions of the flexible net.

2. A display apparatus according to claim 1, wherein said flexible net is characterized by being integrally formed of transparent resin.

3. A display apparatus according to claim 1, wherein each of the display modules is made by assembling three-primary color LEDs of red, blue and green on a wiring board, along with sample-and-hold circuits and a LED driver.

* * * * *